United States Patent [19]

van Cutsem

[11] 4,250,689

[45] Feb. 17, 1981

[54] PACKING DEVICE

[75] Inventor: Philippe van Cutsem, Brussels, Belgium

[73] Assignee: Conorelec, Uccle, Belgium

[21] Appl. No.: 24,614

[22] Filed: Mar. 28, 1979

[30] Foreign Application Priority Data

Mar. 30, 1978 [DE] Fed. Rep. of Germany ..... 2813793

[51] Int. Cl.[3] ..... B65B 35/30; B65B 9/06

[52] U.S. Cl. ..... 53/443; 53/450; 53/542; 53/547

[58] Field of Search ..... 53/443, 450, 542, 547, 53/550, 209

[56] References Cited

U.S. PATENT DOCUMENTS

| | | | |
|---|---|---|---|
| 338,021 | 8/1867 | Liedtke | 53/547 |
| 2,296,142 | 9/1942 | Campbell | 53/547 |
| 3,016,667 | 1/1962 | Kerhoas | 53/550 |
| 3,402,524 | 9/1968 | Griner | 53/542 |
| 3,402,803 | 9/1968 | Griner | 198/425 |
| 3,445,986 | 5/1969 | Salomon | 53/542 |
| 3,648,431 | 3/1972 | Hartbauer | 53/586 |
| 3,662,875 | 5/1972 | Salomon | 198/425 |
| 3,664,088 | 5/1972 | Sherman | 53/547 |
| 4,098,392 | 7/1978 | Greene | 198/425 |

FOREIGN PATENT DOCUMENTS

| | | | |
|---|---|---|---|
| 2259769 | 1/1974 | Fed. Rep. of Germany | 198/425 |

*Primary Examiner*—John Sipos

[57] ABSTRACT

There is described a label-packing device comprising a slit provided in the label-traversing path downstream of a separating device for feeding the packing material underneath the label column, a separating member comprised of a retaining element for the labels upstream of the separating device and a spacing element to push the label downstream to form a space between the labels and to uncover the packing material in the space thus formed, a member for inserting a U-shaped inset element through said traversing path, said inset element having two side cheeks equally spaced from the formed space and folding the packing material back upwards.

34 Claims, 6 Drawing Figures

PACKING DEVICE

This invention relates to a packing device, particularly for labels, of that type comprising a fixed traversing path over which labels are fed discontinuously and pushed as a continuous column by the edge thereof, by means of a discontinuously-acting push member, guide means for the pushed label column, label-retaining means to retain the label column when the push member is unoperative, a separating device comprising a separating member insertable between two labels in the column when the push member has stopped, and packing means for the packages separated by the separating member comprising a packing-material feeding device, a cutting device to cut said material and means for applying said material over the separated packages, as well as possibly a device for cutting-out labels lying between said push member and said separating device.

The invention further pertains to a packing method, particularly for labels, which comprises discontinuously feeding labels on the edge thereof to a feeding path, discontinuously pushing said labels over said path to form a continuous label column, possibly cutting-out the labels in column formation, separating label packages from the column by inserting at each stopping of the discontinuous pushing, a separating member between two labels, feeding a packing material, cutting said packing material and applying said cut material over the separated packages, so as to retain the labels assembled in each package.

There are known presently label-packing devices in which at the outlet from a punch through which the labels have passed to be cut-out in the final shape thereof under the action of the push-rod from a hydraulic jack, the labels are collected by hand and wrapped with a resilient band to retain said labels together or arranged inside a cardboard tray. Such devices have the drawback of manual handling, which increases severely the cost of packing the labels, as well as of the danger as the operator takes a package with at least 1000 labels, that part thereof will fall down or that labels will be arranged upside-down.

There is known a device as defined in the preamble (German Federal Republic Utility Model No. 1,835,773) in which the label column is pushed through an adhesive strip lying at right angle to the feeding direction of the label packages. A sealing member seals each strip after wrapping thereof about a package.

This device has the drawback that the packing material used is an adhesive strip. There results necessarily that some adhesive is transferred to the label edge and during the following stage in the treatment, that is the glueing of the labels on the container, bottle or similar, the glueing blade will take along a plurality of labels. In the case of very large packages with a thousand labels for example, and even if the strip is of adhesive nature, it does not hold the labels strongly enough together. Finally severe problems are encountered as soon as the labels have some other shape than a rectangular shape. Indeed the labels may have shapes which are from partly to completely round, triangular or similar to crown sectors and in such a case the packing strip does not enable a satisfactory packing.

There are also known packing devices, so-called banderolling devices (U.S. Pat. No. 4,074,508) in which packages from in-line labels are fed towards a strip from thermofusible material having a width which is substantially narrower than the label width, arranged at right angle to the label package feeding direction. A sealing member seals each strip after wrapping thereof about a package. Said device has the drawback that it is usable only with labels which have not passed through a punch, that is of rectangular shape and this for the same reasons as given for the above-described device. On the other hand it is difficult to contemplate preparing with such a device strong packages containing for example 5000 labels.

There is also known a packing device sold by the Blumer Maschinenbau firm which comprises a device in which the traversing path along which the labels are fed is directed along an upwards-slanting plane, the label being fed in packages of 1000 for example with an intervening cardboard piece before passing trough the punch which feeds the cut-out labels to a chute which is also directed upwards. At the top thereof a device expels the intervening cardboard pieces from the label column by inserting in place thereof a blade which causes each label package to be fed into buckets moving along an endless chain. The labels are assembled inside a device which coats the label top edges with an adhesive material ribbon. The drawback of such a device lies in the labels not being suitably retained together if there is no actual transfer of adhesive material between the labels and in such a case, there is a danger of tearing or taking along a plurality of labels together as they are used in the following apparatus, for example during bottling. Moreover as in all the other devices described above, it is only possible to pack but a limited number of labels if the assembly is not to disintegrate easily. Finally the push member does only allow to pass the labels through the punch and some other separate conveying system should be provided for the labels for the following operations.

There is also known from U.S. Pat. No. 3,648,431 a device which comprises a device for separating flat goods to be packed which is comprised of two components spaced from one another after being inserted together between two flat articles. Said separating device has the drawback that it can only be inserted into a space already formed between both said flat articles by the apparatus feed device and thus the separating device is permanently bound for the operation thereof to said feed device, which cannot be the case when it is required that a continuous label column pass through a punch and when the separating has to be performed after said cutting-out device. The spacing of both components of the separating device according to said U.S. Patent is obtained by driving the one component by means of the label conveying belt, said arrangement again cannot pass through a punch.

This invention has for object to provide a label packing device which may operate automatically from the push member feeding to the formation of label packages which are completely wrapped by the packing material and which does not have the drawbacks of the above-described devices, as well as the designing of an automatic packing method allowing a complete wrapping of the label packages.

According to the invention, the label-packing device comprises a slit provided in the traversing path between the possible cutting device and the separating device for the label packages through which slit a continuous sheet of packing material is fed between the label column and the traversing path, the separating member of the separating device comprising a label-retaining element upstream of the separating device and a driving spacing element for pushing the labels downstream to form a space between the upstream labels and the downstream labels, and to release simultaneously the packing material sheet, the packing material cutting device being so arranged as to cut the sheet within the so-formed space, an inserting member for an inset element in the formed space through an opening provided in the traversing path, said inset element being generally of U-shape with both side cheeks thereof located with a spacing from one another which is equal to the width of the formed space, and used as means for turning upwards the cut edges of the packing material sheet over the front face of the label column and the back face of the last separated label package, as well as means for enclosing said cut edges during the column feeding and means to fold the packing material sheet over all of the sides of the thus-formed packages, as well as means for closing the packed packages.

In another embodiment of the invention, both cheeks from each inset element are joined together at the lower end thereof by a cross-member is provided at the bottom thereof, with a depending projecting which is slidable inside a lenthwise groove in parallel relationship with the label movement axis, said groove being provided in the traversing path downstream of said opening. The cheeks of the inset element have rims projecting outside along the bottom of each of said cheeks respectively in the direction of the push member and the opposite end of the traversing path, said rims allowing to fold and enclose the flaps suitably formed against the respective faces. That side facing the bottom of said cross element projection, of the inset element is provided with a rack for catching folding and closing means. The inset element cheeks have cut-outs which open towards the top end of said cheeks.

In an advantageous embodiment of the invention the retaining element for the separating member is a knife blade which is arranged in parallel relationship with the labels, and which is connected to operating means made fast to a fixed support to be slidable under the action of said operating means, between a high position above the label columns and a low position between two labels. The spacing element of the separating member is comprised of a twin knife blade the blades of which are so spaced as to be locatable precisely on either side of the retaining element in parallel relationship with the labels, the total width of the retaining element and the spacing element being shorter than the label length, and which is connected to operating means made fast to a movable support in such a way as to be slidable between a high position lying above the label column and a low position where the blades lie adjacent the traversing path, the movable support being connected in turn to at least one operating means made fast to a fixed support to be slidable along the movement direction of the labels and vice-versa, between the one position where the retaining element and the spacing element lie together and at least one position where the spacing element is away from the retaining element.

In an improved embodiment of the invention, the member for inserting an inset element is comprised of two parallel legs joined together to form an U-shaped part, said legs having the free ends thereof directed to that side opposite the push member and being so arranged as to support an inset element inserted on said legs, and said inserting member is connected to operating means made fast to a fixed support to be slidable up and down relative to the support while retaining the legs in parallel relationship with the traversing path plane, between a low position below the traversing path and a high position in the traversing path plane.

In an advantageous embodiment of the invention, the means for folding that packing material lying in parallel relationship with the sides of the label packages respectively against the front face of the separated package and the back face of the previously separated package comprise lever arms swingably secured to a cross-piece of the movable carriage, the free ends of said lever arms being located in the one position thereof, on either side of the space between the separated package and the previously separated package, and in the other position thereof near one another facing said faces in that space formed by the inset element, said free ends each bearing a double jack the one push-rod of which is movable towards the push member and the other push-rod in the opposite direction, so as to fold in side flaps back on said faces, by covering simultaneously the cheek of the inset element, as well as a jack made fast to a cross-piece of the movable carriage and hingedly connected to the lever arms, said jack retaining in the high position the lever arms spread away and in the low position the lever arms next to one another.

There is provided according to the invention a method as defined above with the characteristic that the packing material feed being made before the separation between the label columns and the traversing path, the method further comprises spacing the package separated from the label column during the stopping, along the same movement direction as results from the pushing, with the formation between the separated package, spaced away, and the label column of a space where the packing material lies free, the cutting of said material being made at this time in the center of said space, inserting from the bottom up into said space an inset element for retaining the space formed during the pushing exerted afterwards on the label column, after removing the separating element, and for imparting said pushing to the separated package, folding upwards the cut packing material against the front face of the column and the back face of that package separated by the inset element during the inserting thereof, and folding the packing material back over all of the other sides of the separated package as well as closing the completely wrapped package.

Other details and features of the invention will stand out from the following description given below by way of non limitative example and with reference to the accompanying drawings, in which.

Figure 2:
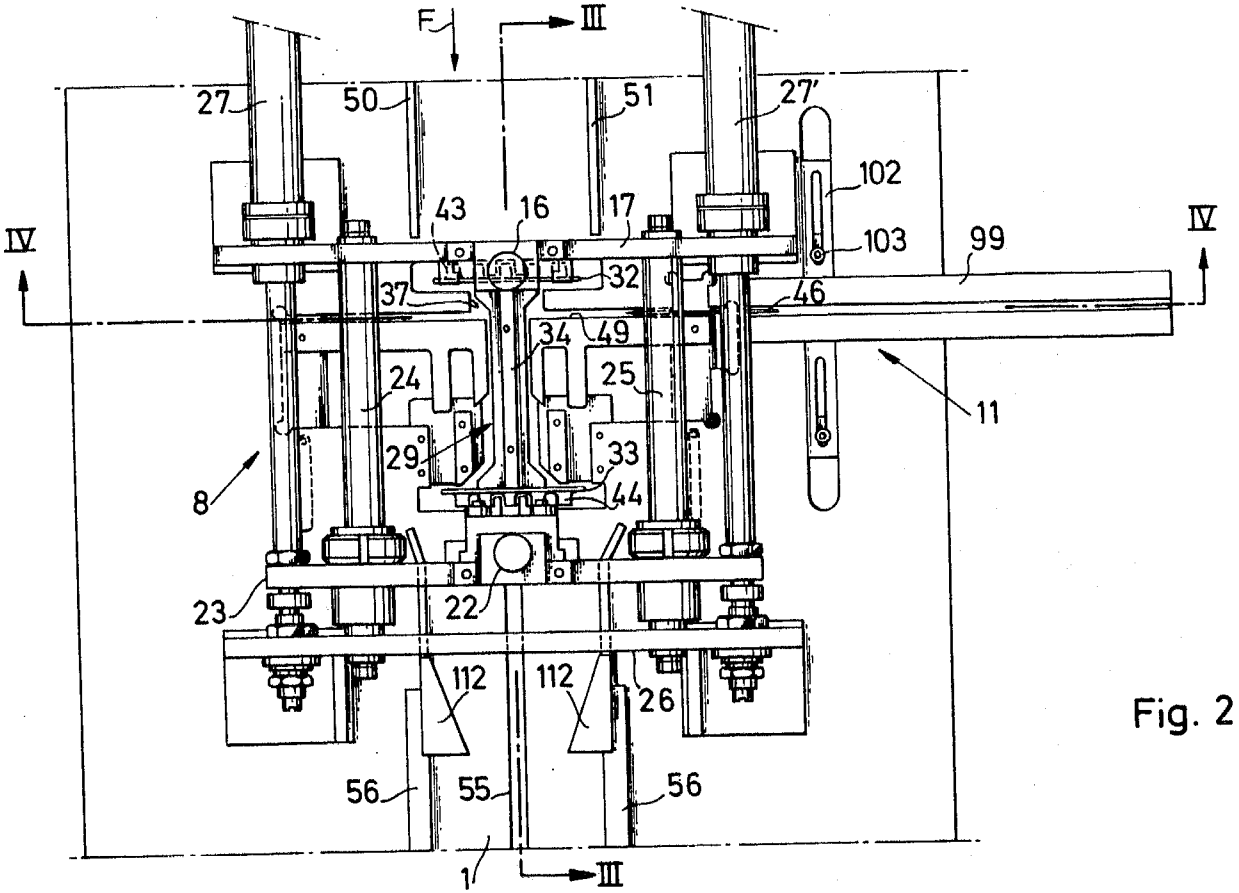
FIG. 2 is a top view of the separating device, the inset element being inserted in that space formed between the retaining element and the spacing element.
Figure 3:
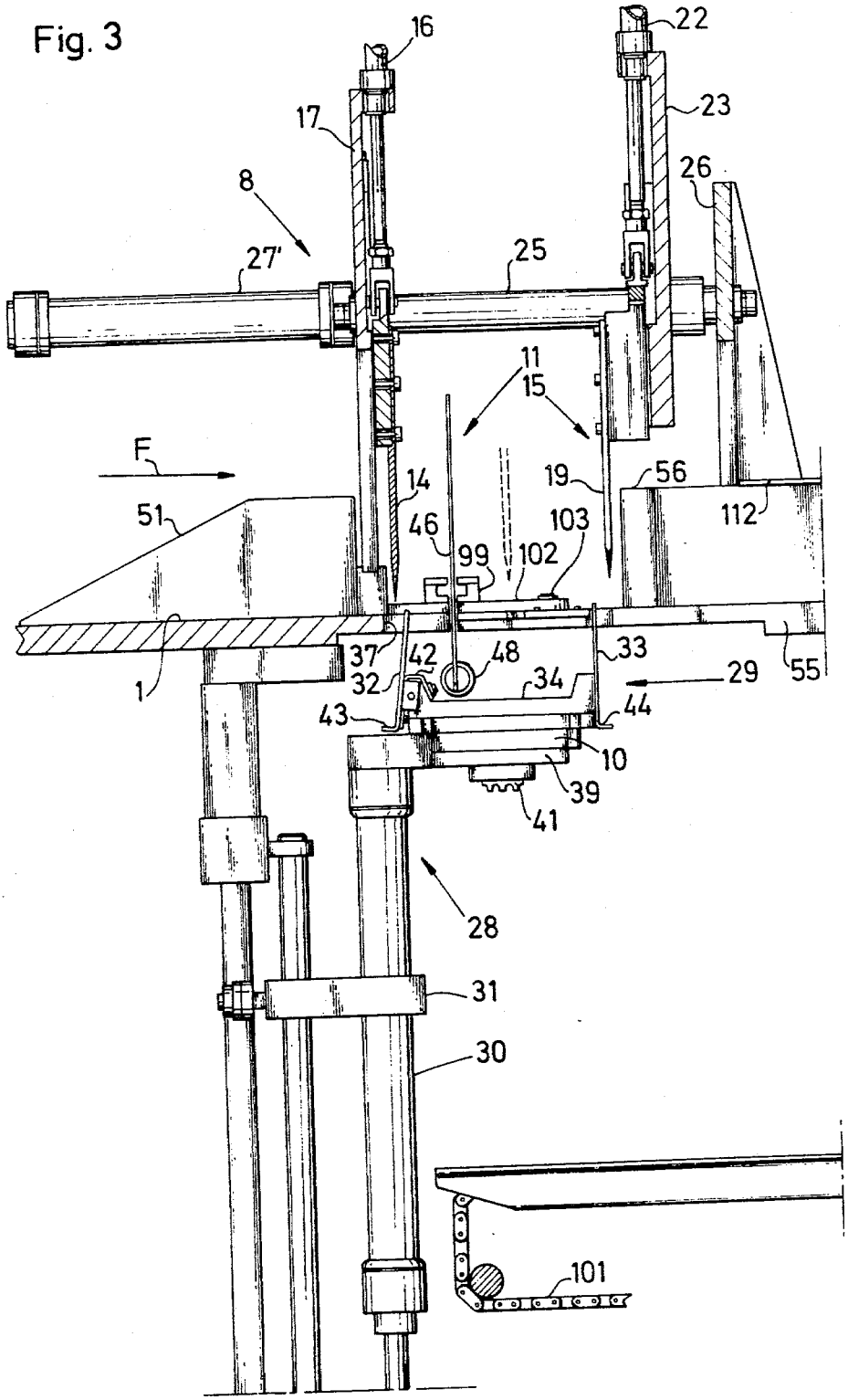
FIG. 3 is a cross-section of the separating device along line III—III in FIG. 2, the inserting member and the inset element being shown in elevation during the inserting of the inset element in the formed space.

The labels have not been shown in FIGS. 2 and 3 for making the drawings clearer.

Figure 4:
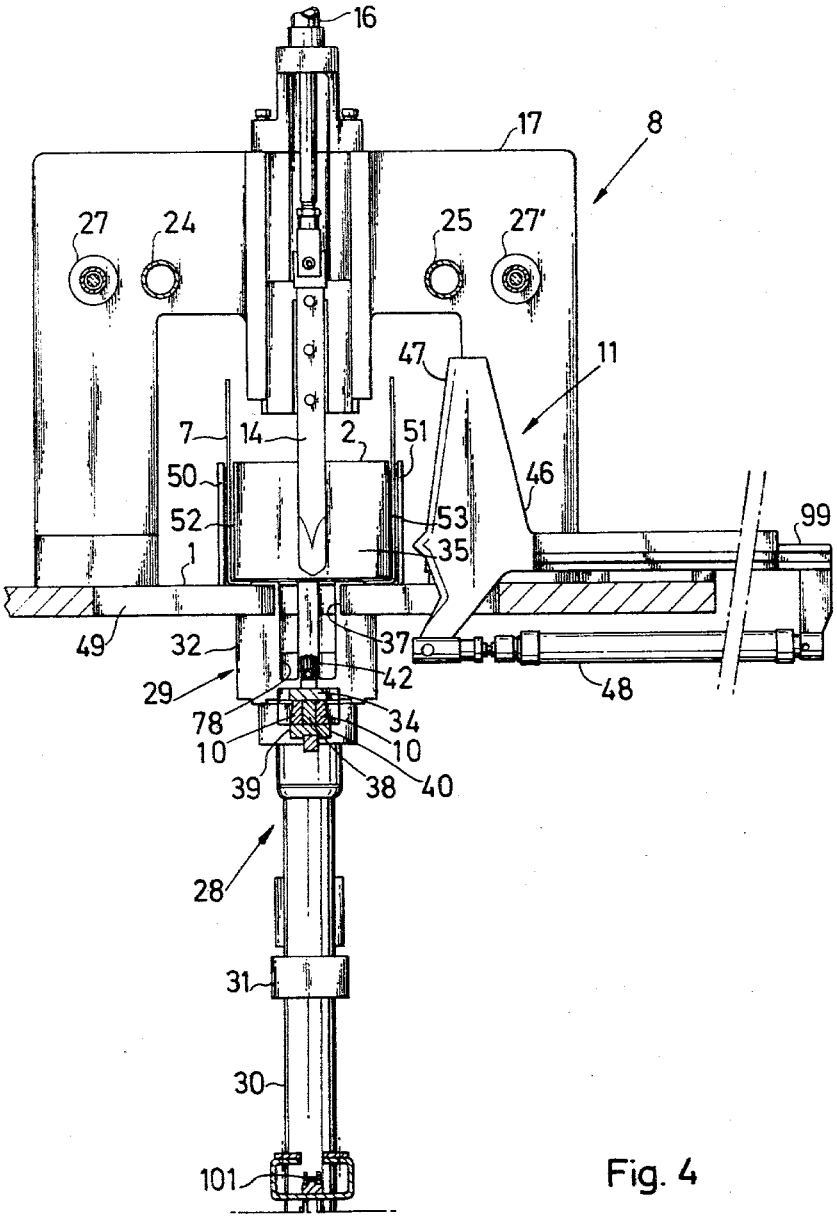

FIG. 4 is a cross-section of the separating device along line IV—IV in FIG. 2, the inset element lying in the position as shown in FIG. 3.

Figure 5:
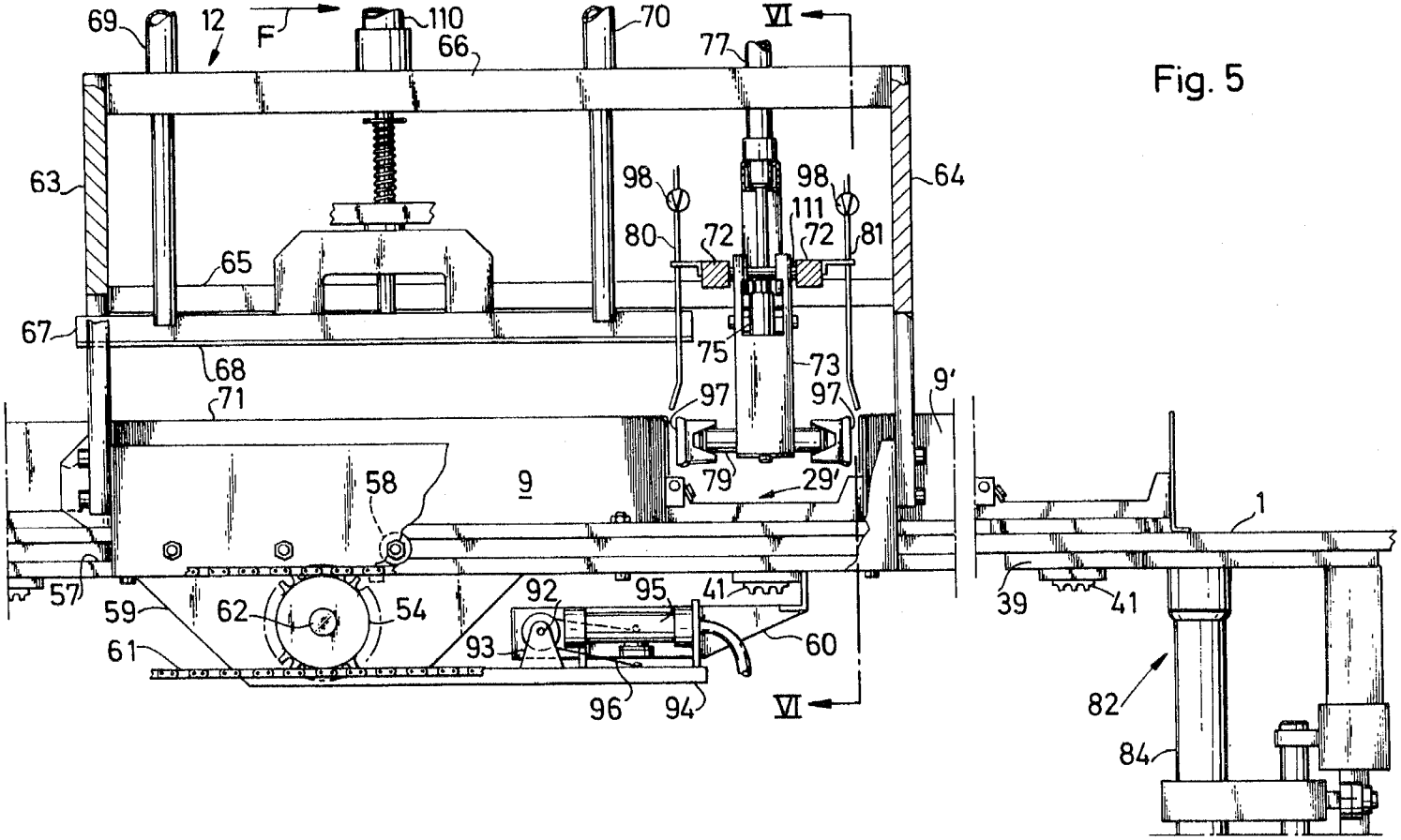
Figure 6:
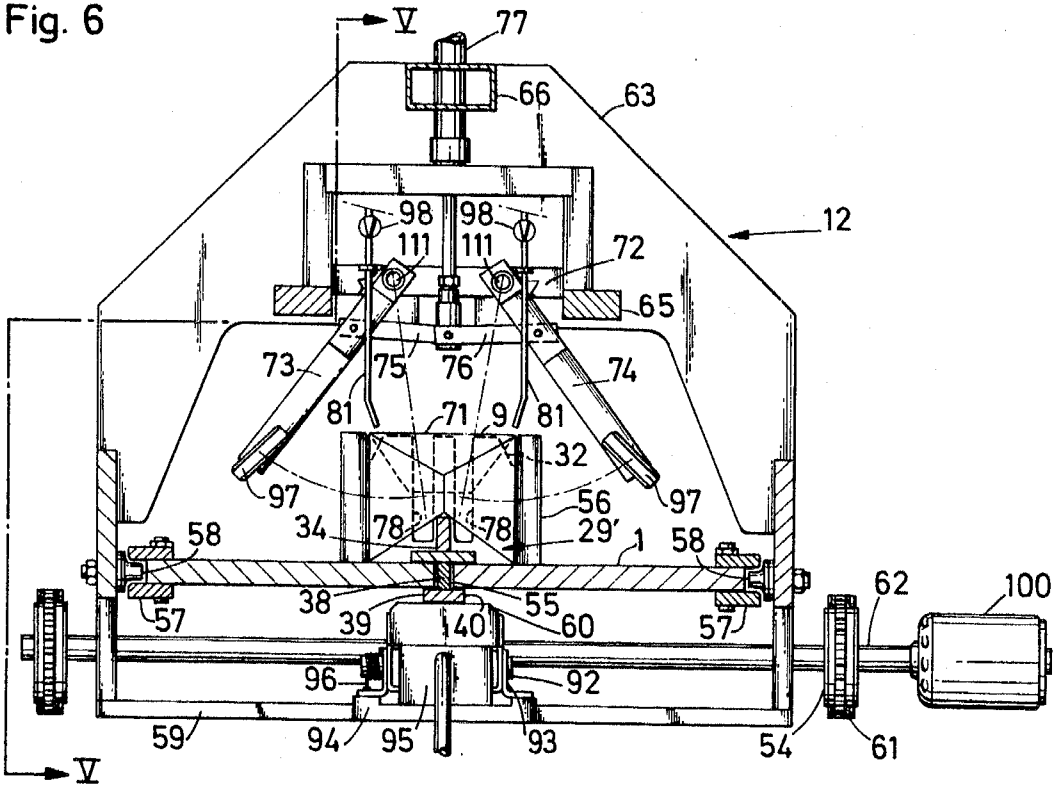

FIG. 5 is a view partly in cross-section and partly from the side of the movable supporting carriage along line V—V in FIG. 6.

FIG. 6 is a cross-section view along line VI—VI in FIG. 5.

Figure 1:
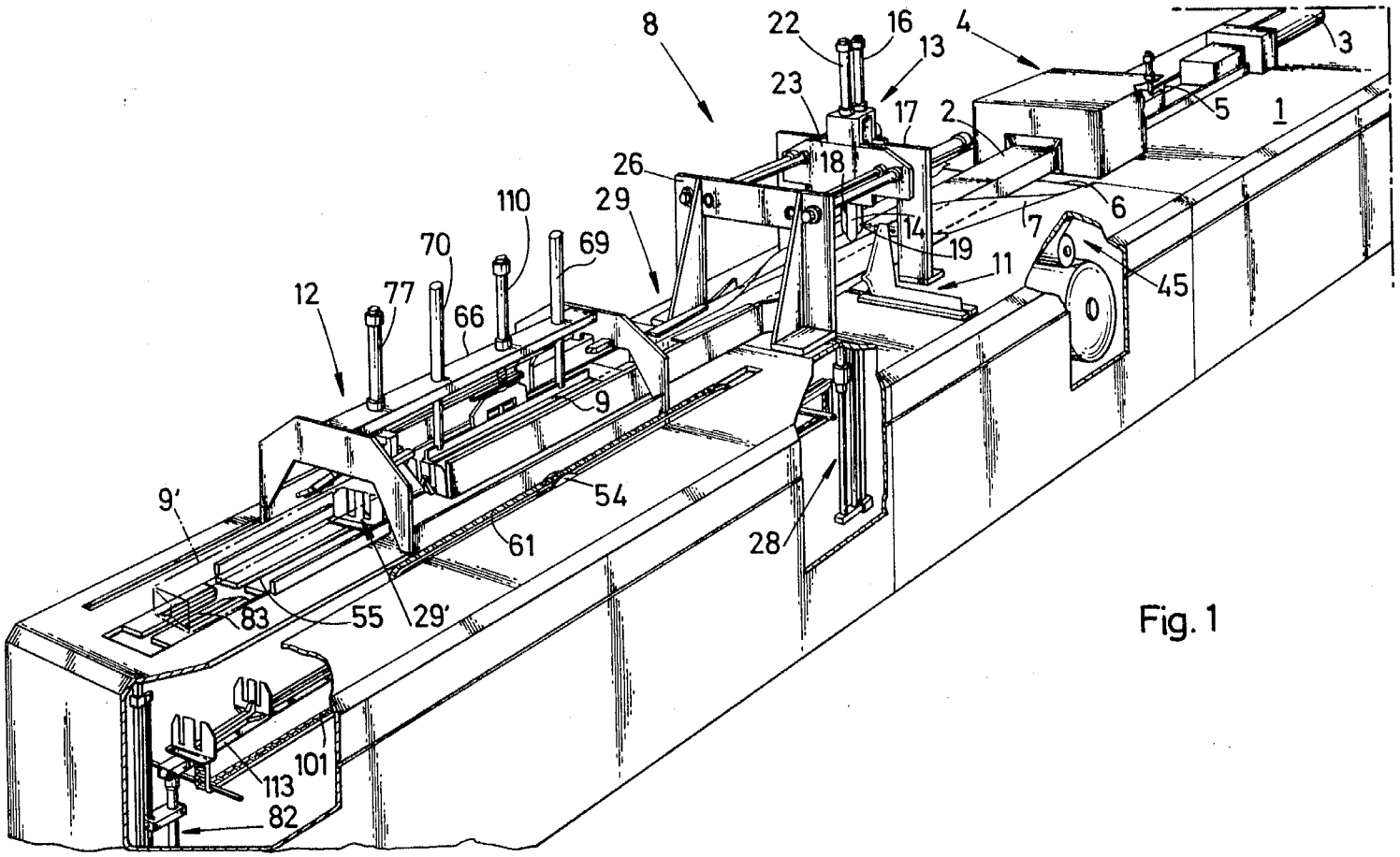
FIG. 1 is general perspective view of a label-packing device according to the invention, including a punch.

As it appears from FIG. 1, the label-packing device according to the invention comprises a fixed traversing path 1 over which labels 2 are fed discontinuously on the edge thereof, a label-pushing member in the shape of a push-rod from a jack, for example a hydraulic jack, acting discontinuously at right angle to the label plane, a punch 4 provided on the inlet side with retaining clamp 5 to retain the labels when the push member is unoperative, a feed slit 6 for a packing material 7, provided in the traversing path 1 between the punch 4 and the separating device 8, said label-separating device 8 being so arranged as to form from the label column 2, label packages 9, 9' which are further displaced down to the end of the traversing path 1, under the action of the push member 3, while being spaced away from one another, a cutting device 11 for the packing material 7 and a movable carriage 12 to which are made fast packing means for the labels and closing means for the formed package. The traversing path 1 for the labels is so arranged that the rectilinear force generated by the push-rod of the push member 3 acts on the labels from one end to the other of the packing device according to the invention.

There appears from FIGS. 2 to 4 that the label-separating device 8 comprises a separating member 13 which is insertable between two labels in the label column 2, during the stopping of the push member 3. Said separating member 13 comprises an element 14 to retain in position the labels upstream of the separating device 8 during the stopping of push member 3, said element 14 being called hereinafter retaining element, and an element 15 for spacing away along the label movement direction as shown by arrow F, those labels lying downstream of the retaining element 14, when said element 14 lies in the position of inserting into the label row (as show in FIG. 4), said element 15 being called hereinafter spacing element. When moving away from the retaining element 14, the spacing element 15 forms a space between the labels the upstream side and the labels on the downstream side of the retaining element 14 (see FIG. 3) and uncovers that packing material 7 lying between the label column 2 and the traversing path 1.

The retaining element 14 in the embodiment shown, is comprised of a knife blade arranged in parallel relationship with the labels above same, the width of said blade being substantially narrower than the label length and the blade thickness tapering downwards. Said blade 14 is connected to a jack 16, for example a hydraulic jack, which is made fast to a fixed support 17, said jack causing the blade 14 to slide from top to bottom and return, the tapering part thereof being directed downwards.

The spacing element 15 from the separating member 13 is comprised of a double knife blade the blades 18 and 19 of which are so spaced as to be locatable exactly on either side of the retaining blade 14 in parallel relationship with the labels. The sum of the width of the blade from the retaining element 14 and the widths of the blades 18 and 19 is smaller than the label length. The blades 18 and 19 25 which are made fast between the fixed support 17 and a similar fixed support 26 located downstream. Two jacks 27 and 27', for example hydraulic jacks secured to the fixed supports 17 and 26 can drive the movable support 23 and consequently the double blade 18 and 19 in the label movement direction and vice versa.

The label-separating device 8 comprises moreover an inserting member 28 for an inset element 29 in that space formed between the blade 14 in low position and the blades 18 and 19 in low position, said blades being spaced along the label movement direction. Said inserting member 28 is located below the traversing path 1 and does comprise two parallel legs 10 connected together to form a U-shaped part, said legs 10 having the free ends thereof facing the side opposite the push member 3. Said inserting member 28 is connected to a jack 30 made fast to a fixed support and so arranged by sliding along a guide 31, as to drive the inserting member 28 from top to bottom and vice versa. In the high position, the inserting member 28 is passed through an opening in the traversing path 1 in such a way that the plane formed by the top edges of U-shaped part legs 10 lie exactly in the plane of the traversing path 1.

The inset element 29 is so arranged in U-shape as to retain when it will be inserted in that space between the blade 14 and the double blade 18, 19, the space formed during the withdrawal upwards of said blades and to transfer the pushing action of push member 3 to the separated label packages 9, 9'. Each inset element 29 comprises two cheeks 32 and 33 connected together by a cross-member 34, the one cheek 32 being designed to bear against the front face 35 of label column 2 on the upstream side of the separating device 8 and the other cheek 33 against the back face of the separated label package 9. The cross-member 34 is provided in the lowermost portion thereof with a depending projection 38 which is slidable between legs 10 of inserting member 28. Said projection has on the side of the free end thereof, side projections 39 and 40 which slide below legs 10 of inserting member 28. That side of projection 38 facing downwards is moreover provided with a rack 41. At least the one cheek (in the embodiment shown cheek 32) is so connected to cross-member 34 as to be swingable towards the opposite cheek 33 (see FIG. 3). A return spring 42 is provided to bring ckeek 32 back to the normal position thereof, that is at right angle to the cross-member 34. Each one of said cheeks 32 and 33 has at the bottom thereof rims 43 and 44 projecting outwards in the direction respectively of the push member 3 and the opposite end of the traversing path 1.

Between the separating device 8 and the punch 4, below the traversing path 1, is arranged a feed device for the packing material 7, which comprises rollers for guiding and tensioning the packing material, to bring same to the slit 6, along a movement direction which is opposed to the label movement direction, the packing material being turned over below the label column 2 after passing through the slit and being driven by said label column during the movement thereof.

The packing material is comprised in the embodiment described, of a thermofusible plastic material sheet, for example polyethylene. Said sheet has a width slightly longer than the circumference of a label.

Between the feed slit 6 and the separating device 8 are arranged two parallel triangular cheeks 50 and 51 which bound the traversing path 1. Said cheeks are spaced from one another by a distance which is substantially equal to the sum of a label length and twice the packing material thickness. The angle formed by each cheek, directed towards the slit, is an acute angle. Said triangular cheeks 50 and 51 are used not only to guide the label column 2, but also to fold back the packing material along the side surfaces 52 and 53 of said column 2.

The cutting device 11 for the packing material sheet 7 comprises a knife 46 which is so arranged as to cut the sheet in that space formed by the separating device 8 before inserting the inset element 29. The spacing between the retaining element 14 in low position and the spacing element 15 in low position as moved in the label movement direction should be large enough for the flaps obtained after cutting to have a length long enough to cover respectively the front face 35 of the label column upstream of the separating device and the back face of the separated package 9. The knife 46 is arranged sidewise relative to the traversing path 1, with the cutting edge 47 thereof facing said path, inside a plane at right angle to the label movement axis. The knife 46 is connected to a jack 48 which can cause the knife to pass through a slit 49 provided in traversing path 1 and to bring said knife back to the original position thereof. That portion opposite to the cutting edge of the knife slides within guides 99 secured next to the traversing path. Said guides have side flanges 102 in each one of which is provided an extended slit in parallel relationship with said traversing path. Clamping screws 103 allow to adjustably fasten the guides 99 bordering the traversing path. The movement of guides 99 sidewise allows to adjust the cutting device according to the size of the flaps to be cut-out. The jack 48 hangs with the push-rod thereof from knife 46 and with the opposite end thereof from guides 99. The slit 49 has a width lage enough to allow adjusting sidewise the above-described knife 46.

The retaining clamps 5 are arranged on either side of label column 2 so as to be retractable when the labels are moved under the action of push member 3, by swinging about an axis at right angle to the label movement direction, jacks connected to a fixed support and clamps 5 projecting into the traversing path, being so arranged as to swing the clamps towards one another down to a spacing smaller than the spacing allowing the labels to go through as soon as push member 3 returns to the original position thereof. Said jacks stop to work when push member 3 begins again the forward motion thereof. The push-rod from push member 3 moves in the end position, slightly beyond the clamps 5 in such a way that the pushed labels be retained by said clamps when the push member becomes unoperative, those labels upstream from the separating device then being retained in position between said clamps 5 and the blade from the retaining element 14.

A retaining rod not shown, that retains those labels which are fed to the push member in upright position on the edge thereof, retains the labels in said position until the push-rod appears in front of the retaining clamps, the retaining rod then being moved away from the labels.

As the punch 4 is used to cut-out in a known way the rectangular labels which pass through, to let the force from the push member generated along a straight line go on acting as defined above, on the labels from one end to the other of the packing device, the plane of the traversing path 1 downstream from the punch 4 is separated from said path plane upstream from the punch 4 by a height corresponding to the height of the lower cutting-out performed on the original rectangular label, both said planes remaining in parallel relationship. Of course when rectangular labels are to be packed, there is no punch and the traversing path is plane from the one end to the other of the packing device.

At the outlet from the separating device 8, the traversing path is provided with a lengthwise groove 55 in parrallel relationship with the label movement axis which opens on the side of the push member 3 into the opening 37 of the traversing path. Said groove 55 has a suitable shape to let slide therein the projection 38 from cross-member 34 from each inset element 29 when same is driven forwards under the action of push member 3, the side projections 39 and 40 and rack 41 provided on said projection 38 projecting downwards relative to the bottom surface of traversing path 1.

On either side of traversing path 1, at the outlet from separating device 8, are provided two parallel rectangular cheeks 56 bordering said path. Said cheeks 56 are spaced from another by a distance corresponding approximately to the sum of one label length and twice the thickness of the packing material. The height thereof is approximately equal to the width of a label. Said cheeks are not only used to guide the separated label packages, but also to retain the packing material against the side surfaces of said packages.

Triangular cheeks 112 in parallel relationship with the traversing path, are secured with the bottom thereof to the top of cheeks 56 at the outlet from separating device 8. They have an acute angle facing said device and allow to fold back the packing material over the top surface of the separated packages 9.

As it is appears mostly from FIGS. 5 and 6, there are also provided on either side of the traversing path 1 at the outlet from separating device 8, two running ways 57 over which the rollers 58 from movable carriage 12 are movable along the label movement direction and the opposite direction. The carriage 12 is comprised of a frame for supporting the folding-back and closing devices for the packing material in the portion thereof lying higher than the traversing path plane. Said frame comprises two end uprights 63 and 64 of bridge shape, each connected at the bottom thereof to the rollers 58 on either side of the traversing path. Said uprights are connected together at the half-height thereof, by two cross-pieces 65 in parallel relationship with traversing path 1 and at the top by a cross-piece 66. The frame is also provided with arms 59 joined together below the traversing path by forming some kind of arch. Said arms 59 bear a hook 60 facing upwards which may engage the rack 41 from an insert element 29' which allows driving the movable carriage 12 under the action of push member 3. The movable carriage 12 is moreover connected to a motor 100, for instance an electric motor, to move temporarily the carriage through a driving chain 61 in the direction of the push member. A gear wheel 54 fast to a shaft 62 swingably supported by the arms 59 and meshing with the driving chain 61 enables to transfer that force generated by motor 100 to carriage 12. The hook 60 is supported on a shaft 92 which is mounted on the arms 59. A jack 95 of flat type, is so arranged as to act on hook 60 to swing same downwards, a return spring 96 being provided to return hook 60 to the original position thereof as soon as the action of jack 95 stops.

A rod 67 having a heating resistor 68 on the surface thereof facing downwards, hangs from two jacks 69 and 70 fast to cross-piece 66, which may lower said rod against the top surface 71 of the separated packages, the heating resistor 68 being used to seal lengthwise the side packing material edges folded back over said top surface 71, and raise rod 67. During the up-and-down movement thereof, the rod is guided by a sliding center rod 110 which goes through cross-piece 66. The resistor 68 is connected to the bottom end of rod 67 to engage surface 71 of the label package and cause sealing together of the side edges of the packing material folded back on said surface 71 when same is heated.

On the carriage front side, two lever arms 73 and 74 are connected with the one end thereof to two cross-pieces 72 through shafts 111, to be swingable thereabout. Said cross-pieces 72 connect both lengthwise cross-pieces 65. An arm 75 or 76 is swingably connected at the one end thereof to the center portion of the corresponding lever arm 73 and 74 and at the other end thereof to a jack 77 made fast to cross-piece 66 in such a way that the push-rod thereof be slidable therethrough. In the rest position, the jack 77 lies at the end of run thereof and the free ends from the lever arms 73 and 74 are spread away from one another by a distance substantially larger than one label length. When jack 77 returns to the starting position thereof, said jack brings the free ends of lever arms 73 and 74 nearer one another in such a way that they face cut-outs 78 provided in cheeks 32 and 33 of that inset element 29' in the space inside which the lever arms 73 and 74 swing back. The free ends from each one of lever arms 73 and 74 bear double horizontal jacks 79 the push-rods of which are movable the one in the label movement direction and the other in the opposite direction. The push-rod ends from said double jacks are each provided with a heating resistor 97 to cause the sealing of the front flaps of the separated packages when said resistor is heated.

Between those planes formed by the ends of each pair of jacks 78 or 79 and the plane of each one of cheeks 32 and 33 from that inset element 29' which drives the movable carriage 12 are arranged directible nozzles 80 and 82 which allow blowing pressurized air downwards, which results in folding that packing material lying over the separated packages back on the front and respectively back faces thereof. Said nozzles are made fast to the cross-pieces 72 and are connected by hoses to a pressurized air source not shown in the drawings. Valves 98 are provided between the hose and each nozzle to open or close the passageway.

Near the end of the traversing path, a receiving member 82 for the inset elements is arranged inside an opening 83 provided in said traversing path 1. Said receiving member 82 is comprised of two parallel legs 113 connected together to form a U-shaped part the free ends of which face push member 3. The receiving member 82 is located inside the opening 83 in such a way that the plane formed by the top edges of legs 113 (FIG. 1) be located precisely in the plane of traversing path 1. The above-mentioned lengthwise groove 55 opens with that end thereof opposite the push member, into opening 83. The legs 113 of receiving member 82 are so arranged as to receive between them the inset element projection 38, the side projections 39 and 40 passing below said legs 113 during the sliding of projection 38 therebetween. The receiving member 82 is connected to a jack 84 made fast to a fixed support below traversing path 1, to lower said receiving member 82 while taking along the received inset element 29 due to the presence of side projections 39 and 40, and to raise said receiving member 82 alone.

Between the inset-element inserting member 28 in low position and the receiving member 82 in low position is arranged an endless chain 101 which is meshable with the rack 41 from each inset element as same comes to the low position of the receiving member to drive said inset element 29 in the direction of the inserting element 28 it does slide on. Said endless chain 101 is driven from a separate motor not shown in the drawings.

For the working of the device according to the invention, it is possible to provide a semi-automatic or automatic control of the various device units.

In the accompanying drawings neither the control unit nor the sensing devices have been shown for clearness sake. Said components are actually units known per se which are applied to the device according to the invention to insure a completely automatized working thereof.

A photo-cell sensing device allows to sense the number of passages of label packages between that position thereof where said packages are fed to push member 3 and the position thereof when the push-rod of push member 3 lies in the end position thereof. Said photo-cell is connected to a counter which indicates to the control unit the number of packages which have passed through. Every time a determined number of packages, for example 5 packages of 1000 labels, has passed through, the control unit causes stopping of push member 3 after the return thereof to the original position thereof, feeding of a new package to push member 3 that position they lie in in FIG. 1.

The label column 2 pushed by push member 3 during that working cycle which has just been stopped, is retained in the position thereof by the retaining clamps 5.

A sensing device, for instance an end switch, indicates to the control unit that retaining element 14 and spacing element 15 lie in low position. The control unit then causes lowering the jack 30 which bears the inserting member 28 as well as a first movement of jacks 27, 27', in the direction of arrow F to drive forward movable support 23 and consequently the spacing element which pushes in front thereof those labels separated from column 2 and uncovers packing material 7.

A sensing device, for example a switch, indicates to the control unit that the spacing element 15 has reached a distance from the cutting plane of knife 46 which is equal to the distance between said plane and retaining element 14 (see the position of element 15 in dotted lines in FIG. 3). The control unit then stops jacks 27 and 27'.

During the working of the push member, the column 2 has driven between same and the traversing path 1, the packing material 7, for instance a plastic material sheet fed through the feeding slit 6. Said material is then foled back along the side surfaces of column 2 between those cheeks 50 and 51 provided at the inlet to the separating device 8.

Together with the stopping of jacks 27 and 27', the control unit triggers the alternating passage of knife 46 through slit 49. During the passage thereof, the knife cuts packing sheet 7. The knife 46 has first been adjusted inside slit 49 in such a way that the spacing between the cutting plane thereof and respectively the front face 35 of column 2 and the back face of the separated package 9 be large enough for the cut edges to cover completely said faces.

After sensing the return of knife 46 to the original position thereof, for instance by means of a switch, the control unit orders again the forward movement of jacks 27 and 27' up to the end position thereof (see the position of element 15 as shown in solid lines in FIG. 3), the packing material which has been cut and is located between the separated package 9 and the traversing path 1 being simultaneously driven forward during said movement. The raising of jack 30 which then bears not only the inserting member 28 but also an inset element 29 is started as soon as a sensor for example an end switch, indicates the end of the second movement forward of jacks 27 and 27'.

A sensing device such as an end switch, indicates that jack 30 lies in high position and thus that inset element 29 has passed through opening 37 to fill the space between retaining element 14 and spacing element 15. During said raising, cheek 32 of inset element 29 has slightly swung towards cheek 34 under the pressure of the label column and the retaining element, which has made easier the inserting of inset element 29 (see FIG. 3), cheek 32 being returned to the upright position at the end of the raising movement. Cheeks 32 and 33 during said raising have folded the packing material cut edges back against the front face 35 of column 2 and the back face of separated package 9, the rims 43 and 44 of cheeks 32 and 33 being used to fold the packing material and to retain same caught between cheek 32 or 33 and the front face 35 of column 2 or the back face of separated package 9.

The control unit then causes the raising of jacks 16 and 22 to raise the retaining element 14 and spacing element 15. At this time the column 2 is retained in position between the retaining clamps 5 and cheek 32 of inset element 29, while separated package 9 is retained between cheek 33 of inset element 29 and the back cheek of that inset element 29' which has previously been inserted on traversing path 1. transferred not only to label column 2 but also to the separated packages, through inset element 29. The control unit causes simultaneously the stopping and release of motor 100 which has by then returned the movable carriage 12 in the direction of the separating device during the stoppage of the push member, the return of jack 95 to the flat position thereof and thus the raising of hook 60 under the action of spring 96 which allows hooking the movable carriage to rack 41 of inset element 29' and the return of jacks 27 and 27' to the original position thereof, which brings the spacing element 15 back in parallel relationship with the retaining element 14. As under the pushing action of push element 3, the inset element 29' drives movable carriage 12, the inset element 29 exerts simultaneously a backpressure on the label column 2 upstream, which enhances the possibility of obtaining a good cutting-out of the labels by means of the punch.

Right from the outlet of separating device 8, that is already during the forward movement of spacing element 15, the separated package wrapped with the packing sheet then forming some kind of trough, passes below both cheeks 112 which fold the packing sheet back over the top surface 71 of the separated package 9. When hooking of hook 60 to rack 41 is sensed, the control unit causes the lowering e resistor engages same. The heating is stopped after some predetermined time, but the rod 67 is left pressed against package 9 until the push member 3 is stopped.

As soon as the heating of resistor 68 is stopped, the control unit triggers the temporary opening of valves 98 from nozzles 80 and 81, which allows by blowing pressurized air on the top portion of the flaps, to fold back same respectively against the back cheek of inset element 29' engaging the front face of the separated package 9 and the front cheek of inset element 29' applied against the back face of the previously-separated package 9', as well as the return of jack 77 to the high position, which causes the lever arms 73 and 74 to come closer. During said closing movement of lever arms 73 and 74, the ends of the double jacks 79 fold back the side portions of the flaps respectively against the back cheek of inset element 29' and the front cheek thereof. An end switch-like sensor indicates the stoppage of jack 77. In such a position of jack 77, the free ends of lever arms 73 and 74 lie facing cut-outs 78 provided in the cheeks 32 and 33 of inset element 29'. At this time the control unit causes the movement of each push-rod from the double jacks 79 in the direction of the push member and in the opposite direction respectively, and lets an electric current flow through resistors 97. The push rods then bear against the cheeks of inset element 29' and the heating of resistors 97 allows sealing the flaps when engaging same through the cut-outs 78. Such heating is automatically stopped after a predetermined time. The double jacks 79 remain however in pressing position until the working cycle of the push member is ended.

After the signal for stopping the working of push member 3 as described above, the control unit causes besides the operations previously described, the return of jacks 69 and 70 to the high position and thus the raising of rod 67, the return of the push-rod from double jacks 79, the return of jack 77 to the low position, and thus the spreading away of lever arms 73 and 74, the moving of jack 95 to the low position and thus the lowering of hook 60 against the action of return spring 96 as well as the engagement and starting of motor 100.

As it appears from the above, the movable carriage 12 hooked to the inset element 29' moves along the the separated package during a complete working cycle of push member 3. The motor 100 during such time, is disengaged and it is actually the push member 3 which allows moving carriage 12 forward. It is necessary consequently that the folding-back and sealing operations be ended when push member 3 is stopped. At this time carriage 12 is released and motor 100 is engaged to drive chain 61 in the direction to return carriage 12 to the original position thereof where it should lie before the beginning of the following cycle in the working of push member 3.

The inset element 29' released from movable carriage 12 slides at some moment between the parallel legs 113 of receiving member 82. When the sensor arranged between legs 113 sends the signal showing the presence of inset element 29', the control unit causes the return to low position of jack 84 which causes the lowering of inset element 29'. The cheeks thereof slide downwards while getting free from the sealed flaps covering said cheeks, the sealed areas sliding in turn through the cut-outs 78 opening upwards. In the low position of jack 84, the inset element 29' is immediately driven by the endless chain 101 which is driven in turn at this time by a motor not shown (see FIG. 1).

The chain 101 drives inset element 29' up to a predetermined distance from inserting member 28. At this moment said motor is stopped.

As soon as the sensor lying between legs 113 of receiving member 82 does not show any more the presence of an inset element, the control unit causes the raising of jack 82 and consequently of receiving member 82.

When an end switch-like sensor indicates to the control unit the return to low position of the receiving member 28, the motor is started again and the inset element may enter between legs 10 of the inserting member 28. As soon as the sensor lying between said legs indicates the presence of the inset element, the control unit causes a new stopping of that motor driving endless chain 101. At this time, the inserting member 28 is ready for the raising of jack 30 resulting from the sensing of the end of the second forward movement of the spacing element. As soon as the inserting member 28 has left the low position, said motor is started again as well as chain 101.

It must be understood that the invention is not limited to the above embodiments and that many changes may be brought therein without departing from the scope of the invention as defined by the appended claims.

It is for instance possible to provide a device in which the packing material instead of being a thermofusible material sheet, is comprised of paper, for example Kraft paper. The devices for closing the packing instead of being sealing devices for the thermofusible material, will then be devices to apply adhesive strips.

The feeding to the push member may be automatic or a feed by hand. It is possible according to the labels to be packed, to provide or not a punch.

Moreover the dimensions and shapes of the inset element may be changed according to the dimensions and shapes of the labels to be packed and the inset element may for instance have two cheeks fixed relative to the cross-piece.

It is also possible to separate and pack some other goods than labels, for example sheet-like leather goods, etc. . . . .

It is also possible to provide inset element cheeks without cut-outs and seal only the top and side flaps between the resistor of the double jack push-rod and said cheeks, the unsealed lower flap being captured by the other flaps.

I claim:

1. In a packing device, particularly for labels, of that type comprising a fixed horizontally traversing path over which labels are fed discontinuously and pushed as a continuous column by the edge thereof, by means of a discontinuously-acting push member, guide means for the pushed label column, label-retaining means to retain the label column when the push member is unoperative, a separating device comprising a separating member insertable between two labels in the column when the push member has stopped to form separated package groups means for the packages separated by the separating member comprising a packing-material feeding device, a cutting device to cut said material and means for applying said material over the separated packages, and a device for selectively cutting-out at least some forms of labels lying between said push member and said separating device, the improvement which comprises a slit provided in the traversing path between the device for selectively cutting out labels device and the separating device for the label packages, through which slit a continuous sheet of packing material is fed between the label column and the traversing and the downstream labels, and to simultaneously uncover the packing material sheet between the two groups of labels, the packing material cutting device being so arranged as to cut the sheet within the so-formed space, an inserting member supporting an inset element and connected to moving means for upwardly moving said inset element into the formed space through an opening provided in the traversing path after the cutting of said packing material and for downwardly removing said inserting member after the separation of said member from said inset element, said inset element being generally of U-shape and having cheeks thereof located with a spacing from one another which is equal to the width of the formed space so that upon subsequent movement of said push member said inset element moves with said label groups and imparts the movement of said push member to the downstream separated label packages, said inset element being used as means for turning upwards the cut edges of the packing material sheet over the front face of the label column and the back face of the last separated label package, means for enclosing said cut edges over said inset element during the column feeding, and means to fold the packing material sheet over all of the sides of the thus-formed packages, means for closing the packed packages and means for removing said inset element from said closed packages.

2. Device as defined in claim 1, in which said cheeks from said inset element are joined together at the lower end thereof by a cross element which is provided at the bottom thereof, with a depending projection which is slidable inside a lengthwise groove in parallel relationship with the label movement axis, said groove being provided in the traversing path downstream of said opening.

3. Device as defined in claim 2, in which at least one cheek is so connected to the cross-element as to be swingable towards the opposite cheek, against the action of a spring returning said cheek to a position at right angle to the traversing path.

4. Device as defined in claim 2, in which the cheeks of the inset element have rims projecting outside along the bottom of each said cheeks respectively in the direction of the push member and the opposite end of the traversing path, said rims allowing to fold and enclose the flaps suitably formed against the respective faces.

5. Device as defined in claim 2, in which that side facing the bottom of said cross element projection, of the inset element is provided with a rack for catching folding and closing means.

6. Device as defined in claim 2, in which the inset element cheeks have cut-outs which open towards the top end of said cheeks.

7. Device as defined in claim 1, in which the retaining element for the separating member is a knife blade which is arranged in parallel relationship with the labels, and which is connected to operating means made fast to a fixed support to be slidable under the action of said operating means, between a high position above the label columns and a low position between two labels.

8. Device as defined in claim 1, in which the spacing element of the separating member is comprised of a twin knife blade the blades of which are so spaced as to be locatable precisely on either side of the retaining element in parallel relationship with the labels, the total width of the retaining element and the spacing element being shorter than the label length, and said pushing means comprising an operating means made fast to a movable support in such a way as to be slidable between a high position lying above the label column and a low position where the blades lie adjacent the traversing path, and at least one operating means connected to the movable support and made fast to a fixed support to be slidable along the movement direction of the labels and vice-versa, between the one position where the retaining element and the spacing element lie together and at least one position where the spacing element is away from the retaining element.

9. Device as defined in claim 1, in which the member for inserting an inset element is comprised of two parallel legs joined together to form an U-shaped part, said legs having the free ends thereof directed to that side opposite the push member and being so arranged as to support an inset element inserted on said legs, and said moving means comprises operating means connected to said inserting member and made fast to a fixed support to be slidable up and down relative to the support while retaining the legs in parallel relationship with the traversing path plane, between a low position below the traversing path and a high position in the traversing path plane.

10. Device as defined in claim 1, in which the packing material feeding device comprises rollers for guiding and tensioning the packing sheet with a width at least equal to the circumference of one label, said rollers being so arranged below the traversing path as to bring the sheet to said slit which is arranged at right angle to the lengthwise axis of the traversing path.

11. Device as defined in claim 10, in which the packing material is comprised of a sheet from thermofusible plastic material, particularly from polyethylene.

12. Device as defined in claim 1, in which the packing material is comprised of a sheet from paper, particularly from Kraft paper.

13. Device as defined in claim 1, in which the device for cutting the packing sheet comprises a knife arranged sidewise relative to the traversing path in a plane at right angle to the label movement axis, with the cutting edge thereof facing the traversing path inside that space formed between the retaining element and the spacing element, that knife and the cutting edge being slidably mounted in guides bordering the traversing path so as to be movable relative thereo, at a right angle to the label movement direction or vice-versa, and operating means for said knife, said means comprising a jack acting on the knife in such a way as to move same cross-wise relative to the traversing path through a slit provided therein.

14. Device as defined in claim 13, in which said slit is wide enough to allow a sidewise movement of the knife relative to said space, by moving the guides as well as the jack over the traversing path along the label movement axis.

15. Device as defined in claims 8 or 13, in which the spacing element lies in the one position thereof removed from said retaining element at such a distance from that plane in which said packaging sheet cutting means goes through the traversing path which is equal to the distance between said plane and the retaining element, said distances being long enough to cover with the cut sheet edges the front face of the label column and the back face of the separated label package.

16. Device as defined in claim 15, in which the spacing element lies in another position removed from the retaining element, at a distance therefrom which is equal to the distance between both cheeks of the inset element to be inserted.

17. Device as defined in claim 1, in which the means for folding back the packing material to form wrapped label packages comprise means to fold back that packing material fed below the label column along the side surfaces of said column, both cheeks of the inset element being used as folding-back means for the cut packing material in engagement with the traversing path, on the one hand over the front face of the label column and on the other hand, over the back face of the separated label package, means to fold back the packing material side edges over the top surface of the separated label package, means to fold back that packing material lel relationship with the side surfaces of the label packages, on the one hand over the front face of the separated package and on the other hand, over the back face of the previously-separated package.

18. Device as defined in claim 17, in which the means to fold back the packing material along the side surfaces of the label column comprise two parallel triangular cheeks bordering the traversing path between the packing material-feeding slit and the separating device, said cheeks being spaced by a distance substantially equal to the sum of a label length and twice the thickness of the packing material, the angle of each such cheeks bordering the traversing path at the outlet from the spacing device in parallel relationship with the side surfaces of the label packages, said cheeks being spaced from one another by a distance equal to the spacing of said triangular cheeks and having a height substantially equal to a label width.

19. Device as defined in claim 1, in which the means to fold back the packing material side edges over the top surface of the separated label package comprise two coplanar triangular cheeks which are each connected with the bottom thereof to the top of said rectangular cheeks and arranged in parallel relationship with the traversing path, that angle of said cheeks facing the spacing device being an acute angle.

20. Device as defined in claim 17, in which the means to fold back that packing material lying above the label packages, on the one hand over the front face of the separated label package and on the other hand, over the back face of the previously-separated package, the means to fold back that packing material lying in parallel relationship with the side surface of the label packages over said same faces as well as the means to close the packages are arranged on a movable carriage provided with rollers running over runways arranged on either side of the traversing path, downstream of the separating device, said carriage being so arranged as to be connectable to that inset element located between the separated package and the previously-separated package during the push member working cycle.

21. Device as defined in claim 20, in which the carriage comprises a frame formed by uprights and cross-pieces located above the traversing path to bear said folding-back and closing means, and uprights passing above the traversing path to form an arch bearing a hook engageable with the rack provided on that surface facing downwards of the projection from the cross-piece of each inset element and releasable from said rack, a motor connected to the carriage through a transmission chain being so arranged as to be disengaged in the position where the hook engages the rack and to return the carriage to the original position thereof in the hook release position.

22. Device as defined in claim 21, in which the hook is supported on a shaft at right angle to the package movement axis, which is swingable between two bearings fast to the arch-forming uprights, a jack fast to said arch being so arranged as to cause the hook to swing downwards, the release position thereof, against the action of a return spring provided to return the hook to the original engaged position thereof as soon as the jack action ends.

23. Device as defined in claim 20, in which the means to fold back that packing material lying above the label package respectively over the front face of the separated package and the back face of the previously-separated package comprise directible nozzles made fast to the cross-pieces of the movable carriage on the vertical of the packing material, valves allowing to open the nozzles as well as a pressurized gas source connected to said nozzles, the top flaps folded back over said faces covering simultaneously the cheeks of the inset element.

24. Device as defined in claim 20, in which the means for folding that packing material lying in parallel relationship with the sides of the label packages respectively against the front face of the separated package and the back face of the previously separated package comprise lever arms swingably secured to a cross-piece of the movable carriage, the free ends of said lever arms being located in the one position thereof, on either side of the space between the separated package and the previously separated package, and in the other position thereof near one another facing said faces in that space formed by the inset element, said free ends each bearing a double jack the one push-rod of which is movable towards the push member and the other push-rod in the opposite direction, so as to fold the side flaps back on said faces, by covering simultaneously the cheekof the inset element, as well as a jack made fast to a cross-piece movable carriage and hingedly connected to the lever arms, said jack retaining in the high position the lever arms spread away and in the low position the lever arms next to one another.

25. Device as defined in claim 1, in which the means for closing the wrapped packages comprise a device for joining those packing material side edges folded back over the top surface of the label package and means for joining the various flaps obtained on each package face.

26. Device as defined in claims 20 or 25, in which when the packing material is a sheet from thermofusible material, the closing means comprise a rod slidingly connected to the movable carriage frame in parallel relationship with the label package movement axis substantially above the center lengthwise line of the top surface from the separated package, said rod being provided with a heating resistor on that surface thereof facing the label package and being connected at least to two jacks fast to the frame in such a way as to be slidable between said high position thereof and a position for pressing said rod on the label package, said resistor being so arranged as to be operative only when said rod lies in pressing position on the label package, as well as heating resistors at the ends of each push-rod from said double jacks, which seal the flaps respectively against the front face of the separated package and the back face of the previously-separated package through said cut-outs provided therefor in the inset element cheeks, said resistors being also arranged as to operate only when the push-rods bear against the inset element cheeks.

27. Device as defined in claim 20, in which when the packing material is a paper sheet, the closing means comprise a device for applying an adhesive strip along the center lengthwise line of the top surface from the separated package and along the faces from said separated packages.

28. Device as defined in claim 1, which further comprises a member for receiving an inset element lying at that traversing path end opposite the push member, said receiving member being formed by two parallel legs joined together to for an U-shaped part, said legs having the free ends thereof facing the push member and being arranged inside an opening in said traversing path in which opens said lengthwise groove in such a way as to receive between same the depending projection of the cross-piece from an inset element, the receiving member being so connected to an operating means fast to a stationary support, as to be slidable upwards and downwards relative to the support, while retaining the legs thereof in parallel relation ship with the traversing path, between a low position located below the traversing path and a high position located in the traversing path plane.

29. Device as defined in claims 28, in which the depending projection of the cross-piece from each inset element comprises on the free end side thereof, sidewise projections which are slidable below the U-legs of the inserting member and the receiving member, and may cooperate therewith during the lowering of the receiving member, and in the low position of the receiving member, a rack provided on the inset element meshes with an endless chain connecting the low position of the receiving member and the low position of the inserting member.

30. In a packing method, particularly for packing labels, which comprises discontinuously horizontally feeding labels on the edge thereof over a traversing feeding path, discontinuously pushing said labels over said path to form a continuous label column, selectively cutting-out at least some forms of the labels in column formation, separating label packages from the column by inserting at each stopping of the discontinuous pushing a separating member between two labels, feeding a packing material, cutting said packing material and applying said cut material over the separated packages so as to retain the labels assembled in each package, the improvement which comprises feeding the packing material before the separating of the labels between the label column and the traversing path, spacing the package separated from the label column during the stopping of the column by pushing a leading label package in a downstream direction from the column with the formation between the separated package and the label column of a space and thereby uncovering the packing material in said space, cutting said material at this time in the center of said space, inserting from the bottom up into said space an inserting member supporting an inset element for retaining the formed space and thereby folding upwards the cut packing material against the front face of the column and the back face of the separated package, removing the separating element and pushing on the label column and the inset element by said push member thereby moving said column and imparting said pushing to the separated package and separating said inset element from said inserting member, folding the packing material over all of the other sides of the separated package as well as closing the completely wrapped package and removing said inset element from the closed package.

31. Method as defined in claim 30, in which the spacing step comprises when the pushing step has stopped, inserting between two labels from a vertically high position said spacing member which is formed by two elements, the one element, or retaining element of which remains in a vertically low position until the inset element lies in a position where it can maintain by itself the space formed, the retaining element then being removed to the original high position thereof, and said spacing step comprises moving the other element or spacing element of the separating member from the retaining element in low position and along the label movement direction, the spacing element being returned from said moved-away position to the high position when the inset element lies in a position where it can maintain by itself the space formed, and said spacing element is thereafter returned still in high position, against the retaining element.

32. Method as defined in claim 30, in which the inset element inserting step comprises after ending of the spacing and cutting steps, raising an inset element-inserting member through an opening provided flush with the space formed in the traversing path, such a way as to pass said inset element through said opening while folding back upwards the cut packing material, said inserting member lying in high position in the traversing path plane and being lowered singly when the further separating step is ended, the inset element between the raising motion and the lowering motion of the inserting member, having been moved along the label movement direction following the further pushing step which occurs after raising the separating member, the inset element sliding out of the inserting member while taking along the packing material captured between the front face of the label column and the inset element.

33. Method as defined in claim 32, in which the spacing step comprises a first step performed before the cutting step and at the end of which the spacing element and the retaining element are moved away from the packing material cutting plane by an equal distance, and a second step performed after the cutting step and at the end of which the spacing element and the retaining element are spaced from one another by a distance equal to the dimension of the inset element.

34. Method as defined in claim 30, in which a plurality of folding-back operations for the packing material over the separated package surfaces and the closing of the completely-wrapped packages are performed on the separated package moving over the traversing path, the means required for such folding-back and closing operations being driven by the moved inset element.

* * * * *

UNITED STATES PATENT AND TRADEMARK OFFICE

CERTIFICATE OF CORRECTION

PATENT NO. : 4,250,689

DATED : February 17, 1981

INVENTOR(S) : PHILIPPE van Cutsem

It is certified that error appears in the above—identified patent and that said Letters Patent is hereby corrected as shown below:

Col. 2, Line 16, "trough"
should be --through--;

Col. 3, Line 22, "is"
should be --,--;

Col. 3, Line 23, "projecting"
should be --projection--;

Col. 5, Line 62, after "19" insert
--are connected to a jack 22, for example a hydraulic jack made fast to a movable support 23, said jack may cause the blades 18 and 19 to slide from top to bottom and vice versa. The movable support 23 is slidingly mounted on two guides 24 and--;

Col. 8, Line 3, "parrallel"
should be --parallel--;

Col. 9, Line 35, "82"
should be --81--;

Col. 10, Line 49, "foled"
should be --folded--;

UNITED STATES PATENT AND TRADEMARK OFFICE

CERTIFICATE OF CORRECTION

PATENT NO. : 4,250,689

DATED : February 17, 1981

INVENTOR(S) : PHILIPPE van CUTSEM

It is certified that error appears in the above—identified patent and that said Letters Patent is hereby corrected as shown below:

Col. 11, Line 30, after "1."
new paragraph, insert
--The control unit causes as soon as it receives the signal given by an end switch-like sensor indicating that jacks 16 and 22 lie in high position, the push member 3 and the feeding to start working again. The pushing from push member 3 is--;

Col. 11, Line 56,
after "lowering" insert
--of jacks 69 and 70 towards the separated package 9 and lets an electric current flow through resistor 68, which causes heating thereof and allows to seal together the thermofusible sheet edges folded back over the package top surface when the--; delete "e";

Col. 12, Line 31, delete "the"
first occurrence and insert --with--;

Claim 1, Line 23, after "traversing" insert
--path, the separating member of the separating device comprising a label retaining element upstream of the separating device and a driving spacing element having means for pushing the labels downstream to form a space between the upstream labels--;

UNITED STATES PATENT AND TRADEMARK OFFICE

CERTIFICATE OF CORRECTION

PATENT NO. : 4,250,689

DATED : February 17, 1981

INVENTOR(S) : PHILIPPE van CUTSEM

It is certified that error appears in the above—identified patent and that said Letters Patent is hereby corrected as shown below:

Claim 17, Line 12, after "material" insert --lying above the label packages on the one hand, over the front face of the separated label package and on the other hand, over the back face of the previously-separated label package and means to fold back that packaging material lying in parallel--; delete "lel";

Signed and Sealed this

*Twenty-fifth* Day of *August 1981*

[SEAL]

*Attest:*

GERALD J. MOSSINGHOFF

*Attesting Officer*

*Commissioner of Patents and Trademarks*